United States Patent [19]

Rhee

[11] 3,945,041

[45] Mar. 23, 1976

[54] PROTECTIVE DEVICE FOR A PERSON'S RIB CAGE AREA

[76] Inventor: Jhoon Goo Rhee, 2525 N. Ridgeview Road, Arlington, Va. 22207

[22] Filed: Feb. 28, 1975

[21] Appl. No.: 554,080

[52] U.S. Cl. ..... 2/2; 24/117 R; 24/143 A; 24/266; 128/78; 128/578

[51] Int. Cl.[2] ..... A41D 13/00

[58] Field of Search ..... 2/2, 2.5, 243 R, 243 A, 2/16, 22, 24; 428/911; 128/77, 878, 518, 543, 560, 578; 24/73 ES, 266, 117 R, 143 A, 143 R

[56] References Cited

UNITED STATES PATENTS

| | | | |
|---|---|---|---|
| 673,157 | 4/1901 | Burnham | 24/266 X |
| 774,381 | 11/1904 | Dyke | 24/266 |
| 779,765 | 1/1905 | Calkins | 128/543 |
| 1,359,346 | 11/1920 | Fields | 128/518 R |
| 2,817,841 | 12/1957 | Bilecki | 2/22 |
| 3,162,861 | 12/1964 | Gustafson | 2/2 |
| 3,871,367 | 3/1975 | Miller | 128/78 |

*Primary Examiner*—Werner H. Schroeder
*Assistant Examiner*—Moshe I. Cohen
*Attorney, Agent, or Firm*—Millen, Raptes & White

[57] ABSTRACT

This invention relates to a device to be worn around a person's midsection for protecting areas of the rib cage, solar plexus and adjacent areas. The device is useful particularly when one engages in various contact sports such as karate, boxing and the like. The device comprises wrap-around means made of a tough outer casing with resilient foam means therein, is designed to be detachably retained snugly around the body, and is easily put on or taken off.

8 Claims, 5 Drawing Figures

PROTECTIVE DEVICE FOR A PERSON'S RIB CAGE AREA

BACKGROUND OF THE INVENTION

This invention relates to a protective device adapted to be worn by a person and to protect areas of the rib cage, solar plexus and adjacent areas. In particular, the device of the invention is adapted to be worn when one is engaging in various contact sports such as karate, boxing, etc. Depending on the type of contact sport, during training and in organized competition, various blows can be and are directed towards an opponent's body using the hands, fists or feet. The blows are often directed towards the front of the opponent's body and injuries thereto can result. The present invention provides a novel protective device adapted to aid in the prevention of injuries to the rib cage areas of the body.

SUMMARY OF THE INVENTION

It is an object of this invention to provide a novel protective device adapted to be worn around the midsection of a person during engagement in contact sports such as karate, boxing, and the like, which is designed to protect the rib cage areas, solar plexus of the wearer and which can be easily put on and taken off.

Another object of this invention is to provide a novel protective device of simplified construction, which is relatively ineexpensive, and which will reduce injuries to the rib cage area of the wearer while engaging in the sports aforementioned.

Another object of the invention is to provide a novel protective device to be worn by a person around the body in the area of the rib cage, which is not restrictive to the wearer's movements while engaging in the sports aforementioned.

A further object of the invention is to provide a protective device containing novel fastening means for retaining the device snugly around a person's midsection.

Generally, the protective device comprises a resilient material having a tough, outer coating, preferably of plastic which is shaped and adapted to be worn and generally to cover and to encircle the rib cage and adjacent areas of a person's body. The device is designed to allow flexibility when worn, i.e., permit normal movements of the arms, waist and body. The device is detachably secured around the waist by strap means.

Other features and advantages of the invention will become apparent from the following description of a specific embodiment of the device taken in connection with the drawings.

DETAILED DESCRIPTION OF THE INVENTION

Figure 1:
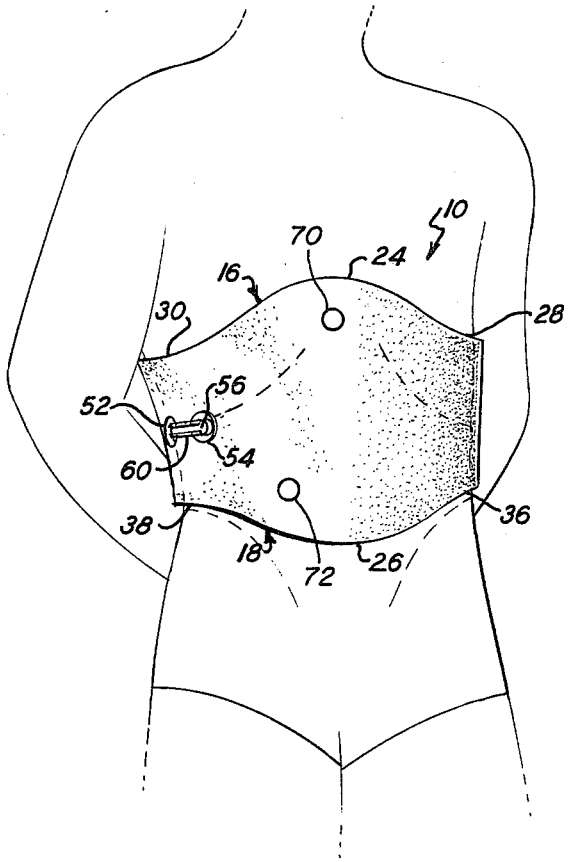
FIG. 1 is a front perspective view of the device as worn by a person.
Figure 2:
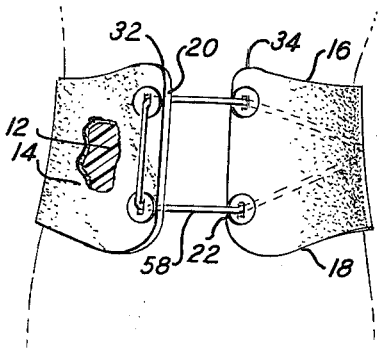
FIG. 2 is a rear elevational view of the device as worn by a person disclosing the manner in which it is secured around the body of the person.

The embodiment of the invention disclosed in the drawing comprises a device generally indicated by the numeral 10. The device, preferably unitary, is formed or molded from a suitable resilient material 12 capable of absorbing energy, such as plastic, i.e., polystyrene or polyurethane foam, or a rubber foam, and the like. A suitable surface coating or casing 14, preferably smooth, covers the entire resilient material throughout, and which is a tough, pliable, tear resistant material, preferably of a suitable plastic material, or the like. The coating 14 can be formed during heating or molding of the resilient foam material to produce a fused coating thereon. Alternatively, the surface coating 14 can be applied on the resilient material by dipping or by applying and securing a coating of a suitable plastic material or the like. Materials of plastic are preferred for the coating since there are available on the market many tough, rugged, pliable materials such as polyvinylchloride, etc. However, it is also contemplated within the concept of thee invention that suitable rugged leather or fabric materials, and the like, can be secured to the resilient material and used to cover the resilient material. The coating or casing used should provide a flexible, tough covering which is resistant to tearing or abrasion.

The device generally comprises a flat member 10 about an inch or more in thickness capable of being flexed and worn around the body of the wearer. It generally has a contoured upper edge 16, a contoured lower edge 18, and end parts 20 and 22.

At the midsection of the device, the upper edge 16 is contoured upwardly at 24 and the lower edge 18 is contoured a lesser amount downwardly at 26. The contoured portions 24 and 26 are adapted to protect most of the front part of a person's rib cage, as well as the solar plexus area and a part of the stomach. The upper edge 16 has downward contoured portions 28 and 30 (FIGS. 3 and 4) adapted to fit around the sides and under the arms of a person without restricting movements of the arms. The upper edge 16 terminates at both ends 20 and 22 with slightly upwardly contoured portions 32 and 34, respectively. The lower edge 18 has upwardly contoured portions 36 and 38 (FIG. 5) adapted to fit over and around the hip bones of a person. The lower edge 18 terminates at both ends 20 and 22 with downwardly contoured portions 40 and 42, respectively.

The end portions of the device comprise reinforced holes adapted to contain fastening means, such as a strap, to enable the device to be secured around the body when it is to be worn. Near end 20, there are disposed vertically spaced holes 44 and 46, and similarly near end 22 there are disposed vertically spaced holes 48 and 50. At a midsection of the device between upper edge portion 30 and lower edge portion 38 there is provided a pair of horizontally spaced, side-by-side holes 52 and 54. Hole 54 is provided with a tongue portion 56 therein.

Figure 3:
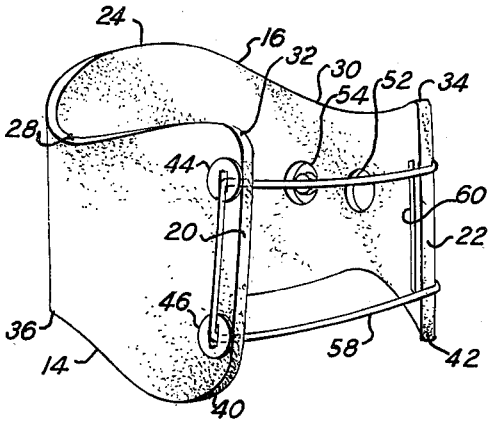
FIG. 3 is a rear perspective view, not worn, showing particularly the upper configuration of the device, and disclosing details of the fastening means.
Figure 4:
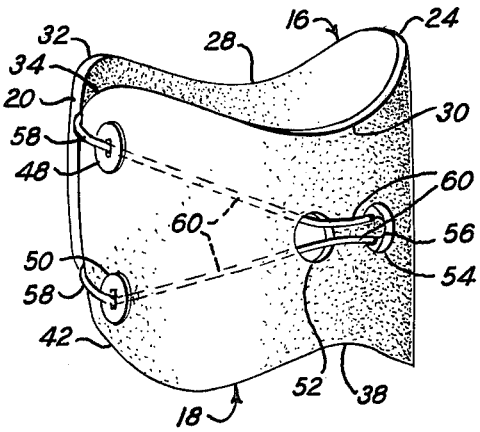
FIG. 4 is a perspective view of one side of the device showing the details of the fastening means as they are fastened when worn.
Figure 5:
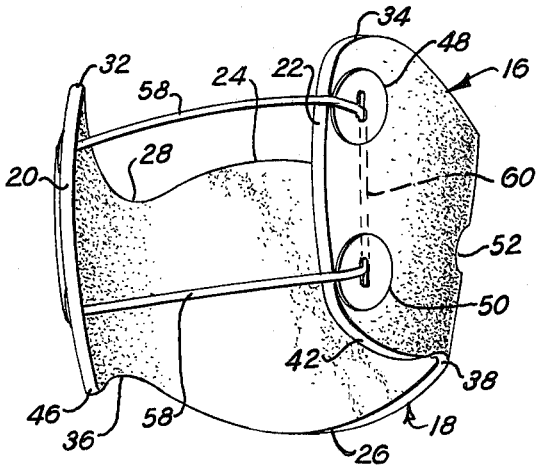
FIG. 5 is a rear perspective view of the device opposite that shown in FIG. 3 showing its bottom configuration.

An elastic, continuous strap 58 is adapted to be disposed within holes 44, 46, 48 and 50 when the device is not fastened on the body of the wearer. AS shown, the strap passes on the outside of the device between holes 44 and 46, between the two ends 20 and 22 and on the inside of the device between holes 48 and 50. As shown in FIGS. 3 and 5, the strap when not worn is disposed only within holes 44, 46, 48 and 50. Holes, such as 70 and 72, can bee provided in the body of the device for ventilation purposes.

When the device is to be worn, the person steps into the device and pulls it up around his body to the position shown in FIG. 1. It is tightened and secured snugly around the body by pulling portion 60 of the strap along the inner part of the device into hole 56 to the outside of the device and into hole 54 around tongue 56. Because the fastening strap is elastic, the device is capable of being worn by persons having various waist sizes. The device is easily removed from a person's body by releasing the strap from tongue 56 pushing the device down on the body and stepping out of it.

As worn and in use, the device 10 protects most of the front rib cage, solar plexus, part of the stomach and both sides under the arms of a person. The construction of the device permits normal body movements of the wearer without restriction thereof. When engaging in sports such as boxing or karate, it protects contestants from injury during training and actual contests.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A protective device for use in athletic contests adapted to be worn around a person's waist for protecting the rib cage and adjacent areas comprising a generally rectangular flexible flat member having casing means with resilient foam means disposed therein, said member having contoured upper and lower edges and identical first and second end sections, said upper edge being contoured downwardly from each end section and then upwardly to define an upwardly extending midsection of said upper edge, said lower edge being contoured upwardly from each end section and then downwardly to define a downwardly extending midsection of said lower edge, vertically disposed holes in each of said end sections, a pair of horizontal holes disposed between said upper and lower edges adjacent said first end section vertical holes, fastening means in one of said horizontal holes, strap means disposed through said vertical holes in said end sections adapted to retain said device in a tubularly disposed shape with said end sections adjacent and separated, said strap means passing through said vertical holes and adapted to be movable through at least said first end section vertical holes, whereby when said device is being worn around a person's midsection a portion of said strap means between said first end section vertical holes can be pulled through one horizontal hole and into the second horizontal hole and fastened therein to thereby pull said adjacent end sections closer together and to thereby snugly secure said device around a person's waist.

2. The device of claim 1 wherein said casing comprises a molded plastic material and said resilient means are plastic foam means.

3. The device of claim 1 wherein said fastening means in said horizontal hole are tongue means.

4. The device of claim 1 wherein said device contains hole means in the body thereof for ventilating purposes.

5. The device of claim 1 wherein said strap means are endless strap means.

6. The device of claim 1 wherein said strap means are elastic.

7. The device of claim 1 wherein said strap means are continuous.

8. The device of claim 1 wherein said casing means is a coating of a plastic material.

* * * * *